United States Patent [19]

Manco

[11] 4,418,794

[45] Dec. 6, 1983

[54] ELECTROMECHANICAL CONTROL FOR HYDRAULIC ELEVATORS

[75] Inventor: Giuseppe Manco, Carugate, Italy

[73] Assignee: Otis Elevator Company, Farmington, Conn.

[21] Appl. No.: 357,005

[22] Filed: Mar. 11, 1982

[30] Foreign Application Priority Data

Jun. 16, 1981 [IT] Italy ..... 22355 A/81

[51] Int. Cl.[3] ..... B66B 1/04

[52] U.S. Cl. ..... 187/17; 187/38; 91/448; 91/450; 91/459

[58] Field of Search ..... 187/17, 38, 32, 34, 187/35; 91/448, 450, 431, 458, 459, 38

[56] References Cited

U.S. PATENT DOCUMENTS 3,437,012 4/1969 Bjorklund ..... 91/448 X 4,148,248 4/1979 Risk ..... 187/17 X

*Primary Examiner*—Joseph J. Rolla

*Assistant Examiner*—Thomas Fitzgerald

*Attorney, Agent, or Firm*—Robert E. Greenstien

[57] ABSTRACT

In a hydraulic elevator, in which fluid is pumped to and from a tank into a piston to raise and lower the car, the flow of fluid is controlled by an apparatus which includes an electric motor that opens and closes a single valve to control the motion profile of the elevator car.

13 Claims, 2 Drawing Figures

ELECTROMECHANICAL CONTROL FOR HYDRAULIC ELEVATORS

DESCRIPTION

1. Technical Field

This invention relates to hydraulic elevators and, in particular, electromechanical controls that are used in hydraulic elevators for controlling the motion of the car.

2. Background Art

In a typical hydraulic elevator, the car is raised by pumping fluid from a tank through a controllable valve cluster into a cylinder that contains a sliding piston which is attached to the car. The car is lowered by releasing fluid from the cylinder and exhausting it through this valve cluster into the tank.

Also, in the typical hydraulic elevator, the acceleration and deceleration (the stopping and starting of the car) is regulated by pilot valves that respond to the fluid pressure to control other valves that throttle the fluid to and from the cylinder. The starting and stopping sequences are initiated mechanically, usually by operating a solenoid that controls a valve that controls fluid pressure on one or more of these pilot valves.

A notable and major disadvantage with these techniques is that changes in the fluid viscosity (from temperature, for example) will change the car's acceleration and deceleration characteristics because the operation of the pilot valves is sensitive to changes in fluid flow, which is directly dependent on the fluid's viscosity.

A somewhat different technique utilizes pressure feedback to control two or more motors that control operation of valves that control flow to the cylinder. One motor controls acceleration, the other controls deceleration, and their operation is regulated in response to the motion of the car. Needless to say, this is very expensive and also very complicated.

DISCLOSURE OF INVENTION

According to the present invention, fluid flow to and from the cylinder is controlled by a single valve that is opened and controlled by a speed regulated electric motor. Flow to this valve from the pump is controlled by valves that regulate the flow as a function of fluid pressure, making the flow through this valve independent of fluid viscosity. Using a constant speed motor, the motion of this valve sets the velocity profile of the car. Variations in car motion resulting from variations in the speed of the motor are eliminated, yielding highly precise and repeatable motion control.

The invention, in short, provides, without the need for any feedback, although feedback, preferably from the car motion, may be used to provide complex velocity control, a simple, exceptionally reliable hydraulic elevator control.

BEST MODE FOR CARRYING OUT THE INVENTION

Figure 1:
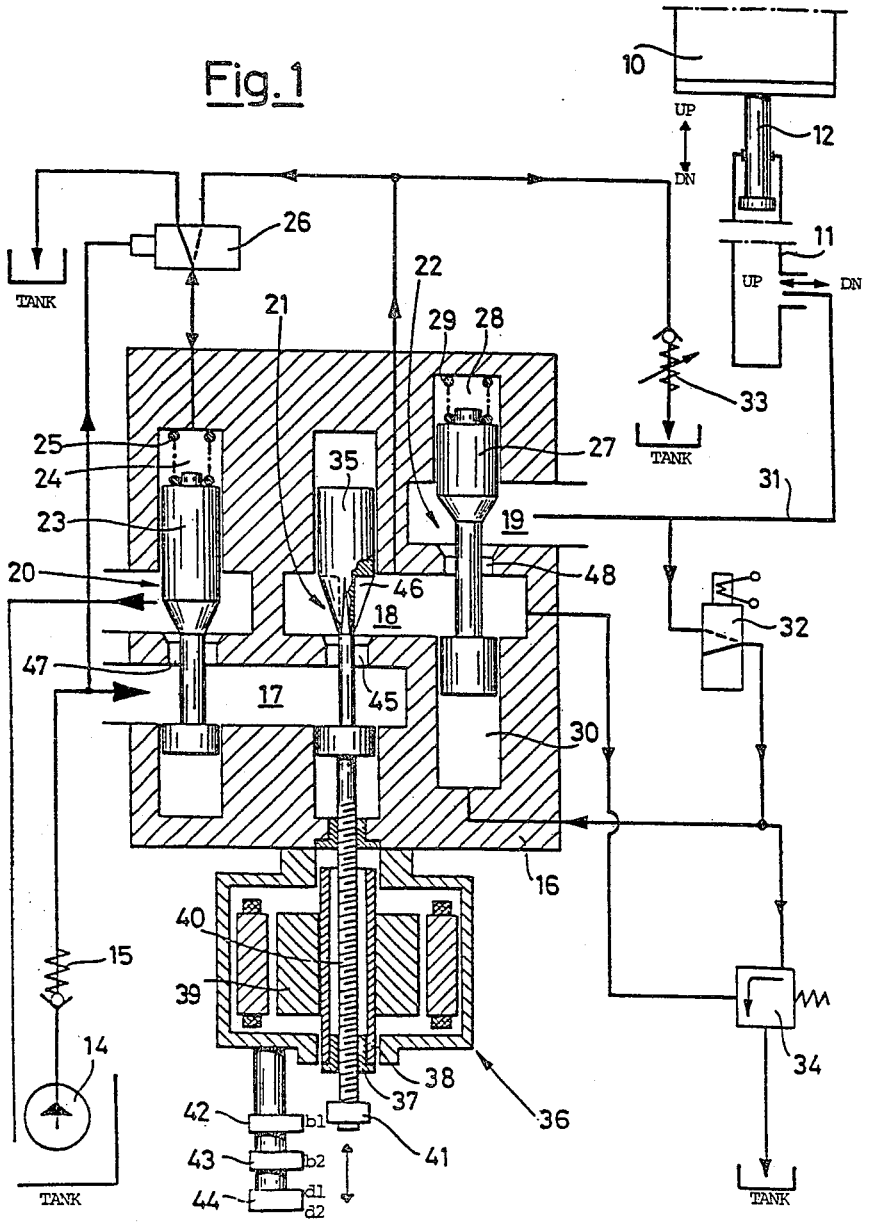
FIG. 1 is a schematic diagram of a control according to the present invention.

The fluid or hydraulic control that is shown in FIG. 1 is used for controlling fluid flow to and from a cylinder 11 that contains a piston 12; the piston is fixed to the car.

To lift the car (ascent), a pump 14 draws fluid from a tank. The pump then supplies the fluid through a check valve 15 to a valve cluster, which is generally identified 16 in FIG. 1. The fluid flow from this cluster to the cylinder 11 pushes on the piston 12 to raise the car 10; the fluid that is contained in the cylinder is exhausted from the cylinder through the valve cluster 16 to the tank or source to lower the car (descent).

The valve cluster contains an inlet port 17, an internal port 18, and an outlet port 19. These, the main fluid flow ports, define the path of fluid flow between the cylinder 11 and the tank.

The port 17 is connected, at one end, with the pump 14 and through a port 47 to the tank 20. The flow through this port 47 is controlled (throttled) by a valve 20. Port 17 actually extends in the cluster 16, as can be seen, connecting there with an internal port 45, whose opening is controlled by a valve 21. Actually, port 45 connects port 17 with port 18, as can be seen. Port 18 is connected to port 19 through an internal port 48, and the opening of this internal port 48 is controlled by position of the valve 22.

The upper part 23 of valve 20 rests in a chamber 24, and in this chamber there is a spring 25 which pushes the valve 23 down. When there is no pressure exerted on the valve 20, from within the port 47, the spring 25 forces the valve closed, closing off the path through the port 47. Chamber 24 is connected to a valve 26, and this valve 26 is connected to the pump and port 18. The pressure within chamber 24 is a function of the operation of valve 26, which is a function of whether the pump is on or off. (The operation of valve 26 is described in more detail later in this description.)

The top (27) of the valve 22 is also located in a chamber, chamber 28; and within this chamber there is also an expansion spring 29 which biases or forces the valve 20 down, to close port 48, if there is insufficient fluid pressure in port 48 to overcome the bias of the spring.

The bottom of the valve 22 rests in a chamber 30, and this chamber is connected to the output of a solenoid valve 32. The inlet to this solenoid valve is supplied from port 19. This solenoid valve 32 is normally open, except for lowering the car.

Port 18 is also connected to the tank through a barometrically controlled valve 33; it is included to overcome barometric variations in fluid pressure within the cluster 16. The reason for its use and the principles behind its operation are well known in the art.

Valve 21 (its position) is the primary determinant of all elevator car motion characteristics. The position of valve 21 is controlled by a speed regulated motor 36 (e.g. constant speed). This motor is attached by a lead screw 40 to the valve 21, and the lead screw 40 passes within a threaded tube 37, which is rotated by the motor. As the motor rotates in one direction, the valve moves down, progressively closing the port 45; as the motor is rotated in the opposite direction, the valve 21 moves up, opening the port 45 progressively more.

It should be observed that the valve 21 cannot completely close off the port 45, for there is a small cut, what might be called internal port 46, on the valve 21.

As a result, when the valve 21 is totally sealed in the port 45, some fluid can flow from port 17 into port 18 through port 46. The reason for this internal port 46 is explained in more detail later in this description.

At the end of the screw 40 is a magnet 41 that is threaded onto the screw 40, making the magnet's position adjustable. This magnet 41 moves up and down with the valve 21, as the motor is operated, passing by three reed switches 42, 43 and 44. These reed switches control power (on-off) to the motor 36. When the magnet 41 is near reed switch 42, the valve 21 is fully opened; when the magnet 41 is near reed switch 43, the valve is at an intermediate port; and when the magnet 41 is near the reed switch 44, the valve is fully closed, except for a small flow that can pass through passage 46. These reed switches 42, 43 and 44 thus sense the valve's position, by sensing the location of the magnet 41.

What now follows is a description of the various modes of operation for the valve cluster 16 in a hydraulic elevator system. The modes include (see the function diagram in block 52 in FIG. 2) raising the car (a1) which includes starting and acceleration to a high speed, movement at constant speed (b1), deceleration (a2) to a low speed (b1), and stopping (e1) and descending the car, which includes starting and acceleration in a descent (a2), descent at high speed (b2), deceleration during descent to a lower speed (c2), lower speed operation (d2), and stopping (e2). These, of course, describe the normal modes of elevator motion; that from a stop the car is accelerated to some high speed, decelerated to some slow speed approach speed and then decelerated to a stop. This occurs whether the car is being lifted (ascent) or brought down to a lower floor (descent).

Raising the Car—Ascent (a1)

To raise the car the pump 14 is first started, but just before that happens, the valves 23, 35 and 27 are in their fully closed positions, and the valves 26 and 32 are at rest (unpowered), which is shown by the solid lines in FIG. 1. Once the pump 14 is started, pressure is applied to valve 20, causing the valve to move upward, which opens the port 47. Fluid then flows from the pump 14 through the check valve 15 through port 47 and back to the tank from which it originated, creating a bypass flow through the port 47. But as this happens, there is a pressure buildup in the chamber 24 as fluid is supplied from the pump through the valve 26 to that chamber, and valve 23 starts to move downward as a result, closing off flow through the port 47. The pressure in port 17 thus increases. The motor 36 is then energized to move the valve 21 upward, and fluid flows from port 17 through port 45 into port 18. The pressure of the fluid in port 18 opens the valve 22; the fluid then proceeds to the cylinder 11.

High Speed (b1)

For a high speed ascent (high speed lift) the valve 21 is moved to its maximum position (magnet 41 is aligned with switch 42). All the fluid from the pump flows into the cylinder 11 and maximum force is applied to the piston 12, which moves at maximum speed, being limited only by the velocity flow from the pump 14.

Deceleration (c1) to Intermediate Speed (d1)

For an ascent at a low or intermediate speed the motor 36 is energized to align the magnet 41 with reed switch 44; as that happens the flow is reduced. A small fluid flow through the orifice 46 is provided, which is sufficient to move the car 10 at a moderate speed (d1).

Stopping (e1)

Finally, to stop the car at the floor, the pump 14 is deenergized, which terminates the flow of fluid to the cylinder 11. The valves 20, 22, which are then fully closed, preventing any reverse flow over the line 31 from the cylinder, and the car thus remains in place because all the valves are at rest.

Descent (a2) from Stop to High Speed (b2)

To accelerate the car from a stop, the valve 32 is energized, and the resultant pressure in the chamber 30, which is connected to line 31 by the valve 32, pushes the valve 22 upward and fluid then flows from port 19 through port 48 into port 18. At the same time the motor 36 is energized to move the valve 21 upward, which results in flow from the port 18 into the port 17. The pressure in the port 17 forces the valve 20 upward, which gives rise to flow through the port 47 and then to the tank.

The motor 36 is energized so as to move the valve 21 to its uppermost position, with the magnet 41 aligned with switch 42. This gives rise to maximum flow from the cylinder 11 to the tank and thus a maximum acceleration (a2) to some desired speed. When the desired high speed (b2) is reached, the motor 36 is energized so as to move the valve 21 downward to a position at which the magnet 41 is aligned with the switch 43, which gives rise to a smaller intermediate flow through port 46, that corresponds to a particular constant car speed (b2) and descent.

Deceleration (c2) to Intermediate Speed (d2)

To decelerate the car from this constant speed (b2), the motor 36 is energized so as to move the magnet 41 to the position associated with reed switch 44. This progressively closes off the flow from the cylinder 11 into the tank through the valve cluster, and the car thus slows down to an intermediate speed which stabilizes itself when the valve 21 is at the position associated with reed switch 44.

Stopping (e2)

To stop the car, the valve 32 is then deenergized, which removes the pressure in the chamber 30, allowing valve 27 to drop down, thereby completely closing off all fluid flow from the cylinder 11.

Figure 2:
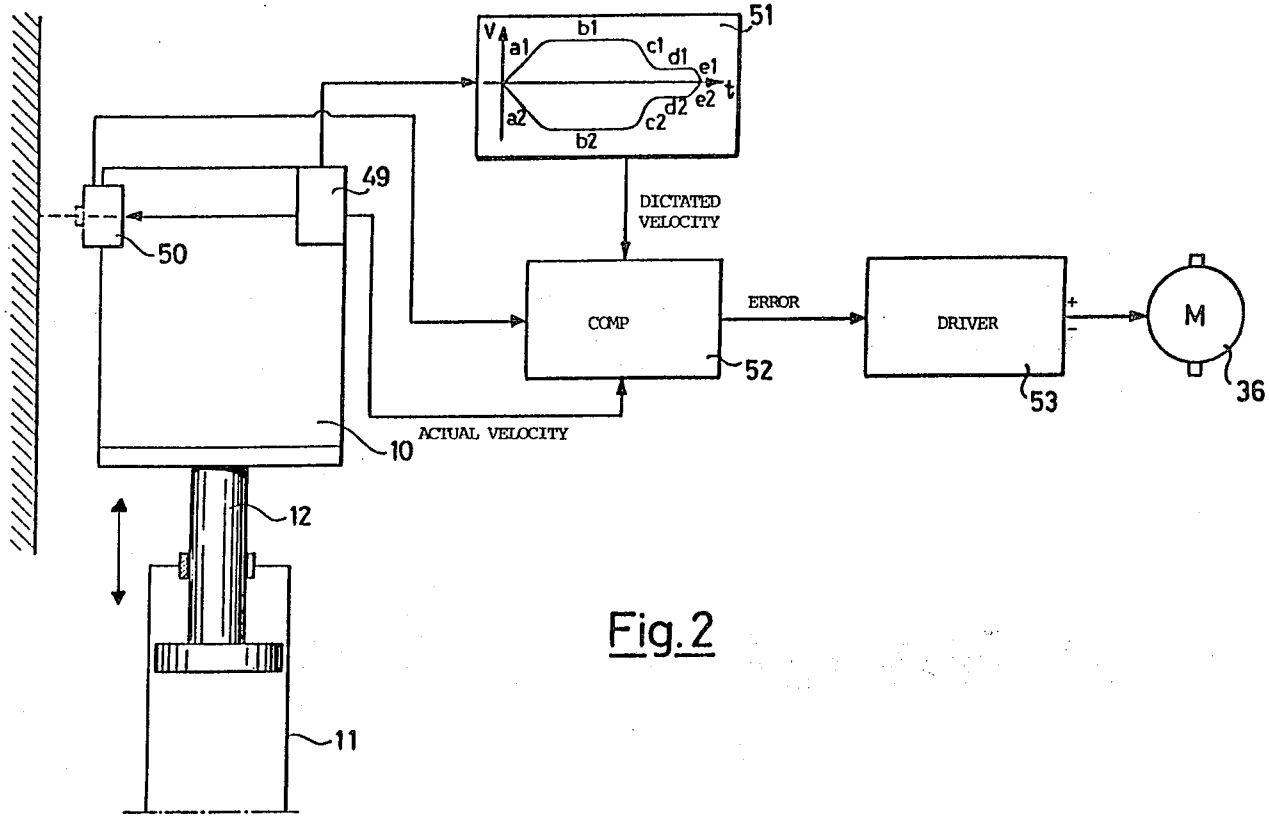
FIG. 2 is a block diagram of an elevator system that uses that control with velocity feedback, sensed from the car.

FIG. 2 shows a closed loop hydraulic elevator control utilizing the present invention, but in this system the velocity of the car is measured by a sensor 50. The operation of this velocity sensor 50 is initiated by a main controller 49 that initiates the operation of a pattern generator 51 that generates acceleration and velocity signal for the car, depending on the time following initiation of a car motion signal. In this pattern generator the positive portions of the graph indicate velocities and acceleration patterns for a1, a2, b1, b2, c1, c2, d1, d2 that have been used previously to describe the sequences for moving the car with the valve shown in FIG. 1.

The output from this pattern generator 51 is supplied to a comparator 52 that receives the velocity signal from the sensor 50. The operation of this comparator is controlled, as required, by the operational or group controller 49. This comparator 52 compares the actual car velocity with the velocity corresponding to the desired velocity (determined by the pattern generator).

The result is an error signal (actual velocity+pattern velocity) that is produced at the output of the comparator 52. This error signal is supplied to a driver that drives the motor 36 in such a way as to modulate the position of the valve 21 between the positions corresponding to switches 42, 43, and 44, so that the velocity of the car will track the velocity corresponding to the output from the pattern generator 51.

Without departing from the true scope and spirit of the invention described in the following claims, there will be numerous modifications, variations and alterations, in whole or in part, to the embodiment of the invention that has just been described.

I claim:

1. Apparatus for controlling the flow of a fluid between a pump, a tank containing the fluid, and a cylinder containing a piston that moves in response to the flow of the fluid in and out of the cylinder, characterized by:

a bypass valve having an inlet port for receiving fluid from the pump and an outlet port connecting with the tank, said valve being biased to provide progressively more bypass flow to the tank in direct proportion to the fluid pressure in the inlet port from the pump;

an adjustable valve having an inlet port for receiving fluid flow from the inlet port of the bypass valve and an outlet port, said first adjustable valve being adjustable to meter the fluid that flows between its inlet port and its outlet port;

an electric motor for adjusting the adjustable valve;

a second bypass valve having an inlet port that is connected to the outlet port of said adjustable valve and an outlet port, said second bypass valve being biased to provide progressively more flow between its inlet port and outlet port as the pressure in the inlet port increases;

a first control valve for applying fluid pressure to the bypass valve to decrease the bypass flow in proportion to the fluid pressure in the outlet of the adjustable valve; and a second control valve that is selectively operable for applying fluid pressure to the second bypass valve to open the second bypass valve in direct proportion to the fluid pressure in the cylinder;

whereby said apparatus allows, when the pump is operating, fluid to flow from the pump through the bypass valve, the adjustable valve and the second bypass valve to the cylinder, whereby the piston is moved in one direction; whereby, upon the operation of the second control valve, when the pump is not operating, the second bypass valve is moved to a position at which fluid may flow from the cylinder through the second bypass valve, the adjustable valve and the bypass valve to the tank to move the piston in the opposite direction; and whereby the motion of the piston in each direction can be controlled by the operation of the electric motor.

2. An apparatus according to claim 1, characterized in that the motor is attached to the adjustable valve by a lead screw coupling to move the valve as the motor rotates.

3. An apparatus according to claim 1, characterized in that the apparatus contains means for sensing the position of the adjustable valve.

4. An apparatus according to claim 3, characterized in that the motor is attached to the adjustable valve by a lead screw coupling to move the valve as the motor rotates; the means for sensing the position of the adjustable valve comprises a plurality of switches and an actuator for operating the switches, said actuator being on the lead screw and its position on the lead screw being adjustable relative to the switches.

5. An apparatus according to claim 1, characterized in that the adjustable valve can be moved between a first position for providing a minimum flow through the valve and a second position for providing a maximum flow through the valve.

6. An apparatus according to claim 5, characterized in that the adjustable valve contains a land that is moved by the motor to control flow through a main port in the valve and a secondary port on the land for providing said minimum flow.

7. An elevator comprising apparatus for controlling the flow of a fluid between a pump, a tank containing the fluid, and a cylinder containing a piston that moves in response to the flow of the fluid in and out of the cylinder, the piston being attached to a car, characterized in that the apparatus comprises:

a bypass valve having an inlet port for receiving fluid from the pump and an outlet port connecting with the tank, said valve being biased to provide progressively more bypass flow to the tank in direct proportion to the fluid pressure in the inlet port from the pump;

an adjustable valve having an inlet port for receiving fluid flow from the inlet port of the bypass valve and an outlet port, said first adjustable valve being adjustable to meter the fluid that flows between its inlet port and its outlet port;

an electric motor for adjusting the adjustable valve;

a second bypass valve having an inlet port that is connected to the outlet port of said adjustable valve and an outlet port, said second bypass valve being biased to provide progressively more flow between its inlet port and the outlet port as the pressure in the inlet port increases;

a first control valve for applying fluid pressure to the bypass valve to decrease the bypass flow in proportion to the fluid pressure in the outlet of the adjustable valve; and a second control valve that is selectively operable for applying fluid pressure to the second bypass valve to open the second bypass valve in direct proportion to the fluid pressure in the cylinder;

whereby said apparatus allows, when the pump is operating, fluid to flow from the pump through the bypass valve, the adjustable valve and the second bypass valve to the cylinder, whereby the piston is moved in one direction; whereby, upon the operation of the second control valve, when the pump is not operating, the second bypass valve is moved to a position at which fluid may flow from the cylinder through the second bypass valve, the adjustable valve and the bypass valve to the tank to move the piston in the opposite direction; and whereby the motion of the piston in each direction can be controlled by the operation of the electric motor.

8. An elevator according to claim 7, characterized in that the motor is attached to the adjustable valve by a lead screw coupling to move the valve as the motor rotates.

9. An elevator according to claim 7, characterized in that the apparatus contains means for sensing the position of the adjustable valve.

10. An elevator according to claim 9, characterized in that the motor is attached to the adjustable valve by a lead screw coupling to move the valve as the motor rotates; the means for sensing the position of the adjustable valve comprises a plurality of switches and an actuator for operating the switches, said actuator being on the lead screw and its position on the lead screw being adjustable relative to the switches.

11. An elevator according to claim 7, characterized in that the adjustable valve can be moved between a first position for providing a minimum flow through the valve and a second position for providing a maximum flow through the valve.

12. An elevator according to claim 11, characterized in that the adjustable valve contains a land that is moved by the motor to control flow through a main port and a secondary port on the land for providing the minimum flow.

13. An elevator according to claim 7, characterized by means for providing a first signal that represents the car's velocity; means, responsive to the first signal, for providing a second signal that represents a desired car velocity for the car's position; means, responsive to the first and second signals, for providing a third signal that represents the difference between the desired velocity and the actual velocity; and means responsive to the third signal for powering the motor to adjust the adjustable valve to cause the car to move so as to reduce the difference between the desired velocity and the actual velocity.

* * * * *